US011680714B2

(12) United States Patent
Lopes De Araujo

(10) Patent No.: US 11,680,714 B2
(45) Date of Patent: Jun. 20, 2023

(54) OUTDOOR COOKING APPLIANCE ENCLOSURE

(71) Applicant: Wilson Lopes De Araujo, Long Branch, NJ (US)

(72) Inventor: Wilson Lopes De Araujo, Long Branch, NJ (US)

(73) Assignee: Wilson Lopes de Araujo, Long Branch, NJ (US)

( * ) Notice: Subject to any disclaimer, the term of this patent is extended or adjusted under 35 U.S.C. 154(b) by 79 days.

(21) Appl. No.: 17/316,949

(22) Filed: May 11, 2021

(65) Prior Publication Data

US 2022/0364739 A1 Nov. 17, 2022

(51) Int. Cl.

| | |
|---|---|
| ***A47B 45/00*** | (2006.01) |
| ***F24C 15/30*** | (2006.01) |
| ***A45B 23/00*** | (2006.01) |

(52) U.S. Cl.

CPC ..... *F24C 15/30* (2013.01); *A45B 23/00* (2013.01); *A47B 45/00* (2013.01); *A45B 2023/0093* (2013.01)

(58) Field of Classification Search

CPC . A47B 45/00; A45B 23/00; A45B 2023/0093; F24C 15/30

USPC ..... 312/100, 102, 205, 313, 314, 315, 316

See application file for complete search history.

(56) References Cited

U.S. PATENT DOCUMENTS

| | | | | | |
|---|---|---|---|---|---|
| 171,683 | A * | 1/1876 | Miller | | |
| 1,694,283 | A * | 12/1928 | Reid | A47B 81/04 | 312/277 |
| 2,253,475 | A * | 8/1941 | Willber | D06F 58/14 | 312/297 |
| 2,486,517 | A * | 11/1949 | Casali | F24B 1/198 | 312/204 |
| 4,919,498 | A * | 4/1990 | Turner | A47B 5/06 | 312/316 |
| 5,245,801 | A * | 9/1993 | Boesvert | A47J 37/0786 | 52/63 |
| D480,892 | S * | 10/2003 | White | D6/657 | |
| 6,634,668 | B2 * | 10/2003 | Urffer, III | A47F 5/108 | 280/47.35 |
| 7,377,077 | B2 * | 5/2008 | Rebeck | E04H 1/1205 | 52/DIG. 14 |
| 2006/0043687 | A1 * | 3/2006 | Downs | B62B 3/02 | 280/47.34 |

(Continued)

*Primary Examiner* — James O Hansen

(74) *Attorney, Agent, or Firm* — Moser Taboada

(57) ABSTRACT

An outdoor cooking appliance enclosure for storing and operating a cooking appliance is provided. The outdoor cooking appliance enclosure includes a base extending horizontally, and a box enclosure extending vertically upward from the base. The base includes multiple guide rods extending vertically upward from the base. The base enclosure is mounted movably on the guide rods. The box enclosure includes a roof mounted on top of, and covering, the box enclosure, a front door shaped to form a closed volume with the box enclosure and the base. The front door includes at least two panels, a first panel and a second panel, where the first panel is mounted pivotably along the front edge of the roof, and the second panel is extendable from the first panel in a direction parallel to the first panel. Multiple extendable legs are mounted pivotably on the second panel.

14 Claims, 7 Drawing Sheets

(56) References Cited

U.S. PATENT DOCUMENTS

| | | | | |
|---|---|---|---|---|
| 2006/0065665 | A1* | 3/2006 | Swartfager | F25D 23/12<br>220/592.2 |
| 2014/0217861 | A1* | 8/2014 | Cole | A47B 45/00<br>312/205 |
| 2014/0352747 | A1* | 12/2014 | Aycan | A45B 23/00<br>135/121 |

* cited by examiner

OUTDOOR COOKING APPLIANCE ENCLOSURE

BACKGROUND

Field

Embodiments of the present disclosure generally relate to an enclosure for a cooking appliance, and more particularly to enclosures for outdoor cooking appliances.

Description of the Related Art

Outdoor cooking appliances, such as outdoor cooking grills are typically exposed to the elements of nature, pests, among other environmental factors. Exposure to heat, cold, rain and the like may cause damage to parts of the cooking appliances, diminish the aesthetics, and decrease the operational life. Exposure to pests such as rodents, insects, and other life forms make the cooking appliance unsanitary, and requires a thorough cleaning for every use. Conventional solutions include covering the cooking appliance in a flexible fabric or plastic cover, which may appear unseemly, and is typically open to the environment from the bottom.

There exists a need in the art for a reliable enclosure system for outdoor cooking appliances.

SUMMARY

Embodiments described herein generally relate to an outdoor cooking appliance enclosure, substantially as shown in and/or described in connection with at least one of the figures, as set forth more completely in the claims. These and other features and advantages of the present disclosure may be appreciated from a review of the following detailed description of the present disclosure, along with the accompanying figures.

BRIEF DESCRIPTION OF THE DRAWINGS

So that the manner in which the above-recited features of the embodiments described herein can be understood in detail, a more particular description of the embodiments, briefly summarized above, may be had by reference to embodiments, some of which are illustrated in the appended drawings. It is to be noted, however, that the appended drawings illustrate only typical embodiments and are therefore not to be considered limiting of its scope.

Figure 1:
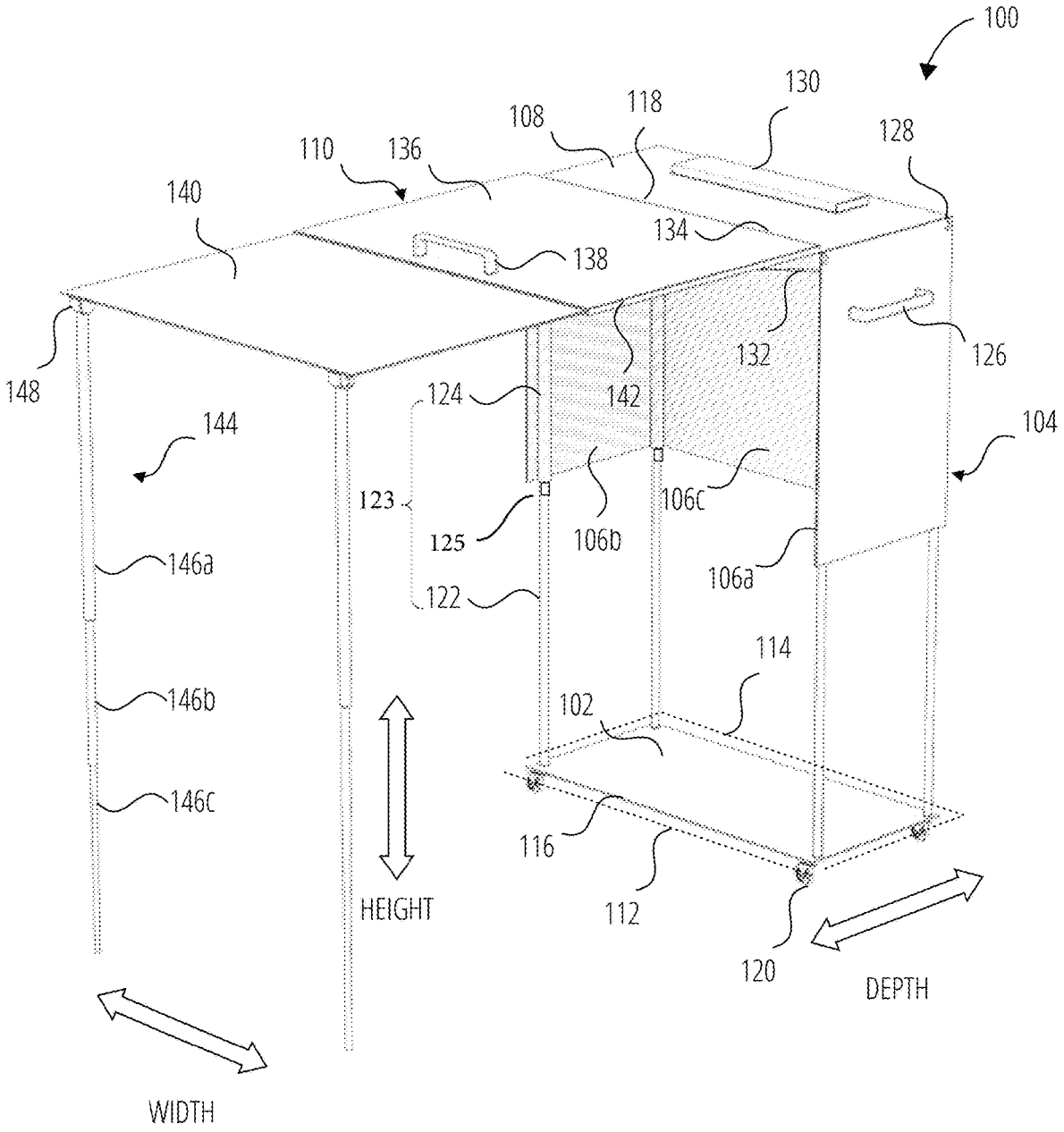
FIG. 1 illustrates an outdoor cooking appliance enclosure in an extended configuration, in accordance with at least some embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments described herein relate to an outdoor cooking appliance enclosure, and provide a rigid enclosure for storing an outdoor cooking appliance and accessories in a compact form in a retracted configuration. The outdoor cooking appliance enclosure is configured to transform easily into an extended configuration, in which the outdoor cooking appliance enclosure transforms from a storage structure to a garage-like structure for the outdoor cooking appliance and accessories, and provides additional shade. In the extended configuration, the outdoor cooking appliance enclosure provides convenient access and comfort to persons operating the outdoor cooking appliance. After use of the outdoor cooking appliance, the outdoor cooking appliance enclosure can easily be transformed back into the retracted configuration for storing the outdoor cooking appliance.

In some embodiments, the outdoor cooking appliance enclosure includes a base, multiple guide rods extending vertically upward from the base, and a box enclosure mounted on the guide rods, and movable in a vertical direction along the guide rods. The box enclosure has a roof opposite the base, and a front door mounted pivotably on the roof. The box enclosure, along with the roof and the front door, can move up and down along the guide rods. The front door includes a first panel which is mounted pivotably from the front edge of the roof, for example, by a hinge. The front door also includes a second panel nested within the first panel, which includes a slot on either sides to allow the second panel to slide in and out from the first panel. The second panel includes extendable legs mounted thereon by a rotatable locking mechanism, and the extendable legs are extendable from a storage length to a desired extended length.

In the retracted configuration, the box enclosure is in contact with or proximate to the base, and the front door is shut on the box enclosure and the base, forming a closed enclosure, for example, for storing the outdoor cooking appliance and associated accessories. To transform the outdoor cooking appliance enclosure to the extended configuration, in a first step, the box enclosure is moved up along the guide rods and locked at a top position. In a second step, the front door is opened by pivoting the front door along a front edge of the roof to extend parallel to the roof, and locked in the extended position. In a third step, the second panel is slid out of the first panel and locked relative to the first panel. In a fourth step, the extendable legs, which are stored in a retracted length along the second panel, are released to hang vertically downward from the second panel, and in a fifth step, the extendable legs are extended to contact the ground. The extendable legs are locked for rotation and length to arrive at the extended configuration.

FIG. 1 illustrates an outdoor cooking appliance enclosure 100 in an extended configuration, in accordance with at least some embodiments of the present disclosure. The outdoor cooking appliance enclosure 100 comprises a base 102 and a box enclosure 104. The base 102 includes multiple casters 120 extending below from the base 102 and supporting the base 102 on the ground, and guide rods 122 extending vertically upward from the base 102 for mounting the box enclosure 104. The box enclosure 104 includes a roof 108 positioned opposite the base 102, a front door 110 mounted pivotably on a front edge 118 of the roof 108, and guide rod receivers 124 corresponding to the guide rods 122, via which the box enclosure 104 is mounted on the guide rods 122, such that the box enclosure 104 is movable in a vertical direction along the guide rods 122.

The box enclosure 104 includes a side handle 126 on one of the sidewalls for assisting in moving the box enclosure 104 along the guide rods 122, anchor hooks 128 on one of the sidewalls to anchor the outdoor cooking appliance enclosure 100 using a rope tied to a stable structure, such as a fixture on a wall or the ground, and a vent 130 on the roof 108 to allow for exhaust, for example, from an outdoor cooking appliance installed in the outdoor cooking appliance enclosure 100. The front door 110 has a shape to define a closed volume with the box enclosure 104 and the base 102 in a retracted configuration of the outdoor cooking appliance enclosure 100.

In some embodiments, the guide rods 122 and the guide rod receivers 124 form a first biasing mechanism 123, such as a gas piston, a spring mechanism, electrical, hydraulic or retractable manual, to bias the box enclosure 104 vertically upward, away from the base 102. In some embodiments, the biasing mechanism moves the box enclosure 104 vertically upward automatically, and in some embodiments, the biasing mechanism assists in moving the box enclosure 104 manually, for example, using the side handle 126. In some embodiments, the guide rods 122 and the guide rod receivers 124 further include a first locking arrangement 125 configured to secure the box enclosure 104 proximal to or in contact with the base 102 in a bottom-locked position, and to secure the box enclosure 104 distal to the base 102, in a top-locked position. In some embodiments, the guide rods 122 and the guide rod receivers 124 may be locked in place via gas or hydraulic pressure, or manual locks that clip into place, with associated lock-release mechanisms. In some embodiments, in the top-locked position, the roof 108 is at a height of about 6 feet to about 9 feet from the ground, or about 7 feet to about 8 feet from the ground.

In some embodiments, the base 102 has a rectangular shape as shown in FIG. 1. The shape of the base 102 is defined by a front profile 112 and a box profile 114. The base 102 has a front edge 116 having the front profile 112, and the rest of the periphery of the base 102 has the box profile 114. The box enclosure 104 has a cross section of the box profile 114, and the front door 110 has a cross section of the front profile 112. The roof 108 is shaped similar to the base 102, and is defined by the box profile 114 and the front profile 112. The front profile 112 of the roof 108 defines a front edge 118 of the roof 108.

In some embodiments, the box profile 114 is a C-shape and the front profile 112 is a straight-line shape. In some embodiments, the C-shape has an angular configuration appearing like a "[" or bracket shape, imparting the base 102 and the box enclosure 104 a cuboidal shape, for example, as shown in FIGS. 1-7. In such embodiments, the box enclosure 104 includes a first sidewall 106*a* connected to a back wall 106*c*, and a second sidewall 106*b* connected to the back wall 106*c* opposite to the first sidewall 106*a*, with boundaries therebetween having a defined, angular configuration. In some embodiments, the C-shape has a continuous curve configuration having an appearance of the letter "C", imparting the base 102 and the box enclosure 104 a three-dimensional semi-circular (or a half cylinder) shape. In such embodiments, the first sidewall 106*a*, the back wall 106*c* and the second sidewall 106*b* form a continuous and curved profile, without any defined boundaries.

The front door 110 includes a first panel 136 pivotably mounted to the front edge 118 of the roof 108 by a hinge 134. A biasing arrangement 132, for example, a gas piston, a spring piston, or other similar devices discussed above with respect to element 122 and/or known in the art biases the first panel 136 to a horizontal position, parallel to the roof 108. In some embodiments, the biasing arrangement 132 includes a second locking arrangement configured to secure the front door 110 in a position such that the front door 110 extends from front edge 118 of the roof 108 to the front edge 116 of the base 102.

The first panel 136 includes a first panel 136 to assist in opening the first panel 136 by pivoting the first panel 136 about the hinge 134. In some embodiments, the front door 110 also includes a second panel 140 which is nested in the first panel 136 via nesting channels or slots 142 on either sides of the first panel 136. The slots 142 accommodate the edges of the second panel 140 slidably, such that the second panel 140 can slide in to and out of the slots 142, while the second panel 140 stays parallel to the first panel 136. In some embodiments, the slots 142 include a third locking mechanism configured to secure the second panel 140 completely within the first panel 136 in the retracted configuration, and configured to secure the second panel 140 fully out of the first panel 136 in the extended configuration. In some embodiments, the slots 142 include a third biasing arrangement to bias the second panel 140 to slide out of the first panel 136 automatically, and in some embodiments, the biasing arrangement assists in manual sliding the second panel 140 out of the first panel 136 manually, for example, using the first panel 136. In other embodiments, the second panel 140 is attached via hinges to an outer edge of the first panel 136.

The second panel 140 includes two or more extendable legs 144 mounted thereon on by corresponding rotation locking arrangements 148. Each of the extendable legs 144 include multiple overlapping legs 146*a*, 146*b*, 146*c*, which may be telescopic, or otherwise capable of collapsing into an overlapping configuration, and capable of extending in an non-overlapping configuration. In some embodiments, the extendable legs 144 include a fourth locking arrangement to lock the legs 146*a*, 146*b*, 146*c* in the overlapping configuration, and in the non-overlapping configuration. In the retracted configuration, the extendable legs 144 have the legs 146*a*, 146*b* and 146*c* overlap in the overlapping configuration such that the extendable legs 144 have a short length, and are secured along the second panel, for example, by the rotation locking arrangement 148. In the extended configuration, the extendable legs 144 hang vertically from the second panel 140, secured in the vertical orientation by the rotation locking arrangement 148. Further, the extendable legs 144 are extended such that the legs 146*a*, 146*b*, 146*c* are in the non-overlapping configuration.

For clarity, FIG. 1 shows by marked arrows that height is in the vertical direction, while width and depth are in a horizontal direction. In some embodiments, the height of the outdoor cooking appliance enclosure 100 in the extended configuration is between about 6 feet to about 9 feet, the width is about 3 feet to about 10 feet, and the depth is about 1 foot to about 3 feet.

Figure 2:
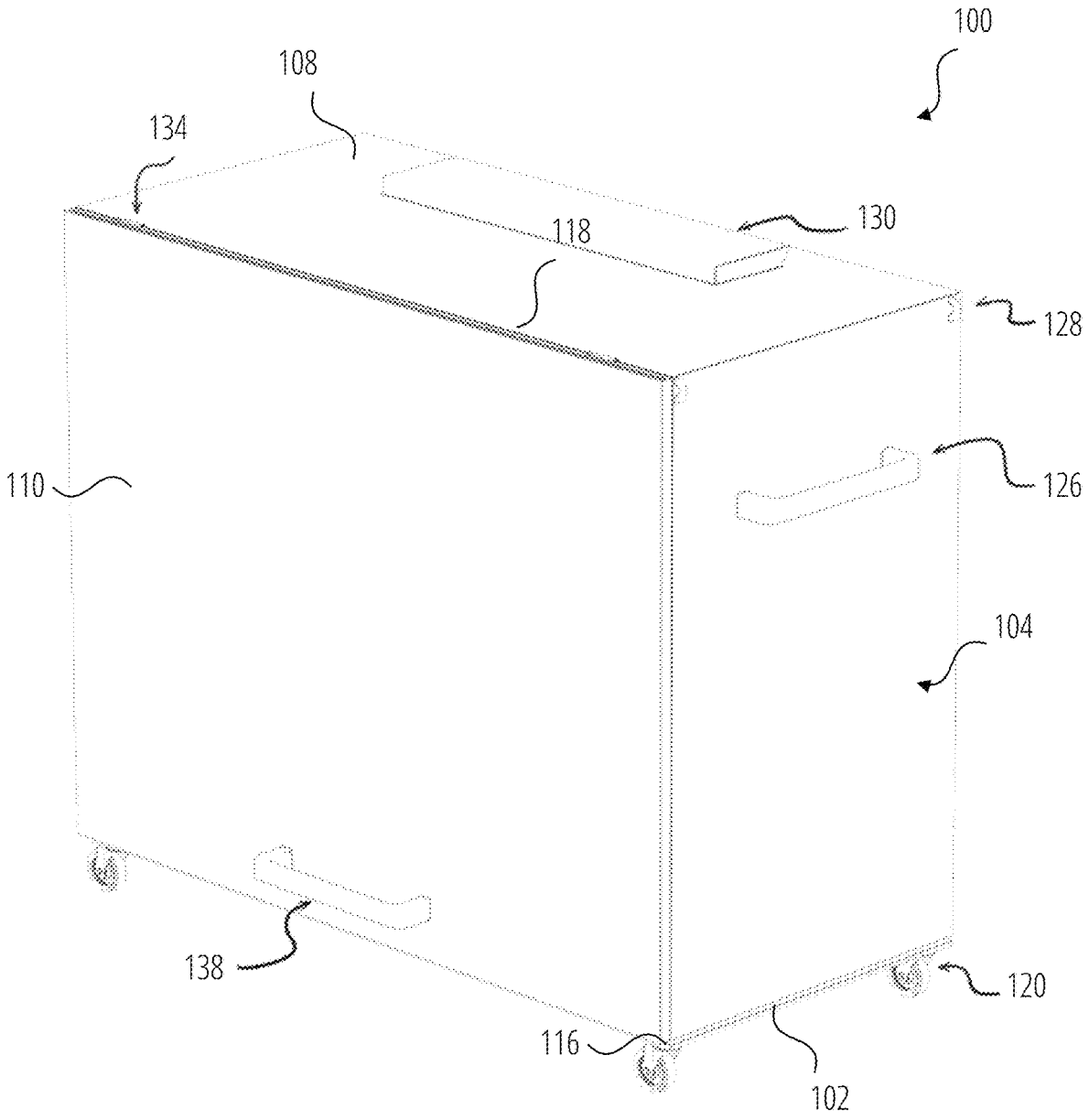
FIG. 2 illustrates the outdoor cooking appliance enclosure in a retracted configuration, in accordance with at least some embodiments of the present disclosure.

FIG. 2 illustrates the outdoor cooking appliance enclosure 100 in the retracted configuration, in accordance with at least some embodiments of the present disclosure. The box enclosure 104 is positioned contacting the base 102 in the bottom-locked position. For example, the box enclosure 104 is secured to the bottom-locked position by the locking arrangement. The front door 110 is pivoted about the hinge 134, and in a closed position, extending from the front edge 118 of the roof 108 to front edge 116 of the base 102. The front door 110, which is opposite the back wall 106*c*, also extends from the first sidewall 106*a* to the second sidewall 106*b*. The front door 110, the box enclosure 104 and the base 102, form an enclosed volume, which is sufficient to accommodate the outdoor cooking appliance. In some embodiments, the height of the outdoor cooking appliance enclosure 100 in the retracted configuration is between about 3 feet to about 5 feet, the width is about 3 feet to about 10 feet, and the depth is about 1 foot to about 3 feet.

Figure 3:
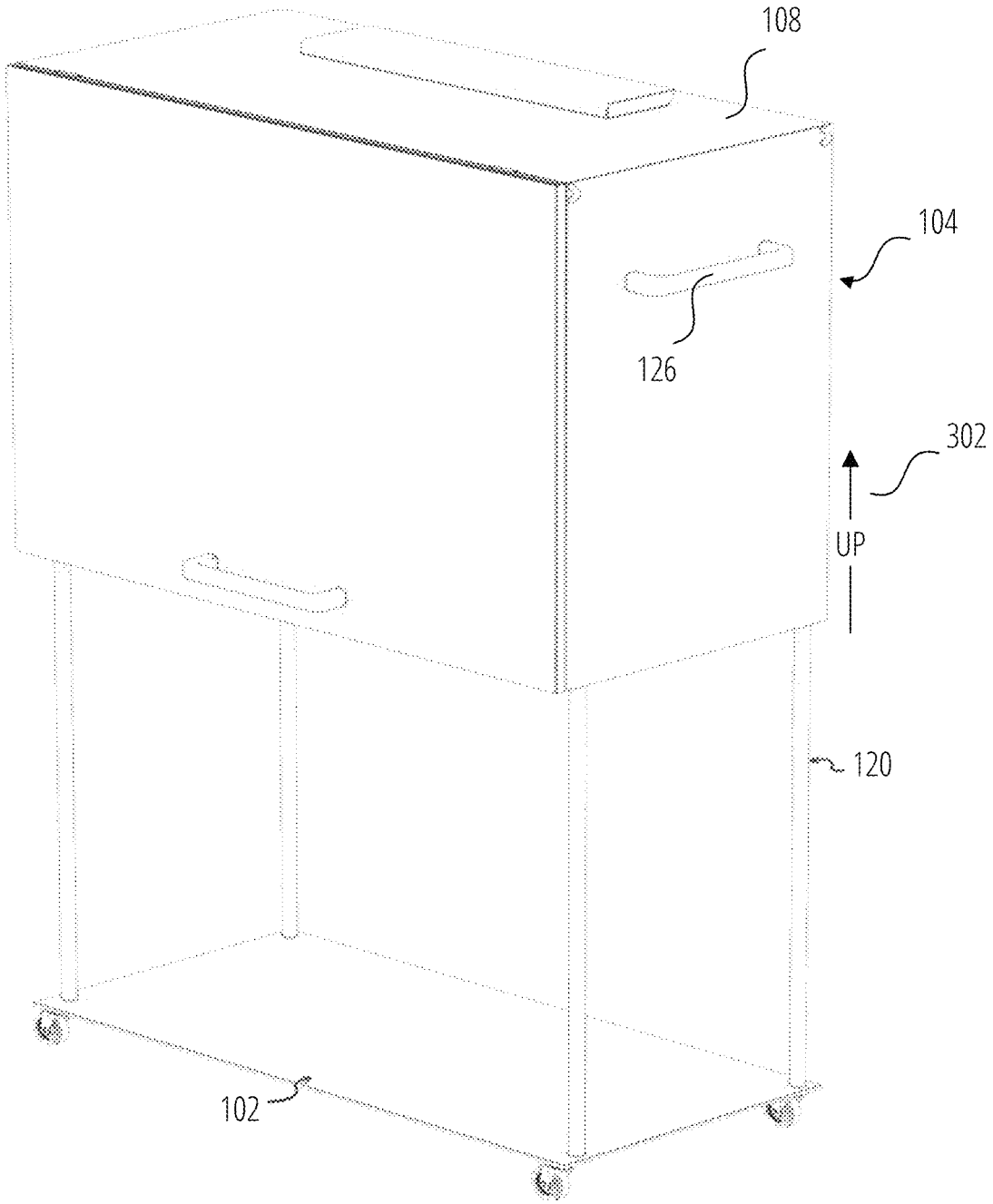
FIG. 3 illustrates the outdoor cooking appliance enclosure in a first interim configuration, in accordance with at least some embodiments of the present disclosure.

FIG. 3 illustrates the outdoor cooking appliance enclosure 100 in a first interim configuration, in accordance with at least some embodiments of the present disclosure. From the retracted configuration of FIG. 2, in a first step 302, the box enclosure 104 is moved up vertically along the guide rods 122. In some embodiments, the box enclosure 104 is moved up manually, for example, by releasing the first locking arrangement to release the box enclosure from the bottom-locked position, and moving the box enclosure 104 vertically upward manually using the side handle 126, to the top-locked position and locking the box enclosure 104 using the first locking arrangement. In some embodiments, the box enclosure 104 is moved vertically upward automatically, for example, by the first biasing mechanism. In some embodiments, the box enclosure 104 is moved vertically upward manually, assisted by the first biasing mechanism. The front door 110 is still in the closed position, extending from the front edge 118 of the roof 108 to front edge 116 of the base 102.

Figure 4:
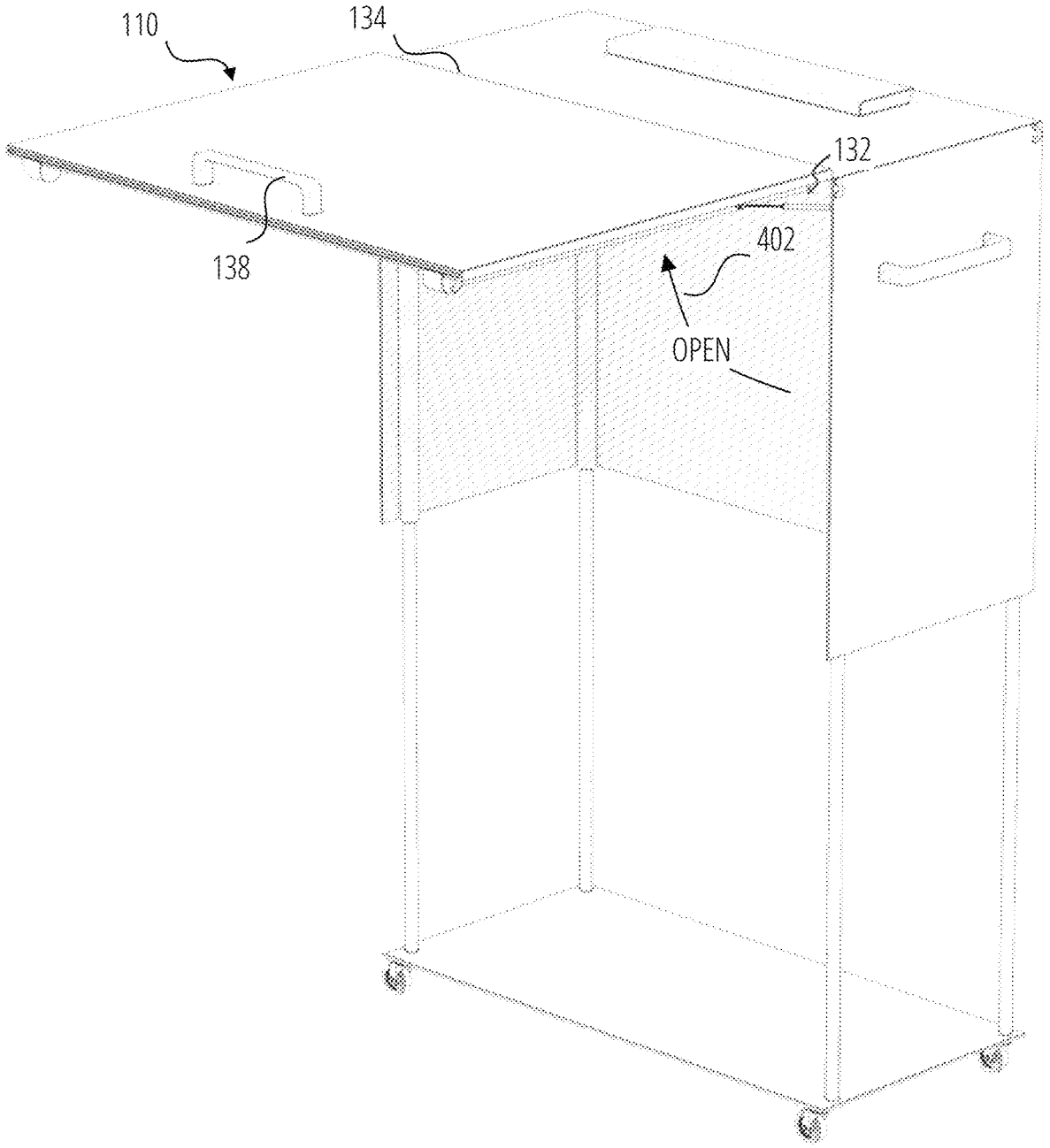
FIG. 4 illustrates the outdoor cooking appliance enclosure in a second interim configuration, in accordance with at least some embodiments of the present disclosure.

FIG. 4 illustrates the outdoor cooking appliance enclosure 100 in a second interim configuration, in accordance with at least some embodiments of the present disclosure. From the first interim configuration of FIG. 3, in a second step 402, the front door 110 is opened, for example by pivoting about the hinge 134, to extend in parallel to the roof 108. In some embodiments, the second locking arrangement is released, and the biasing arrangement 132 pushes the front door 110 open automatically. In some embodiments, the biasing arrangement 132 assists in opening the front door 110 manually, for example, using the front handle 138.

Figure 5:
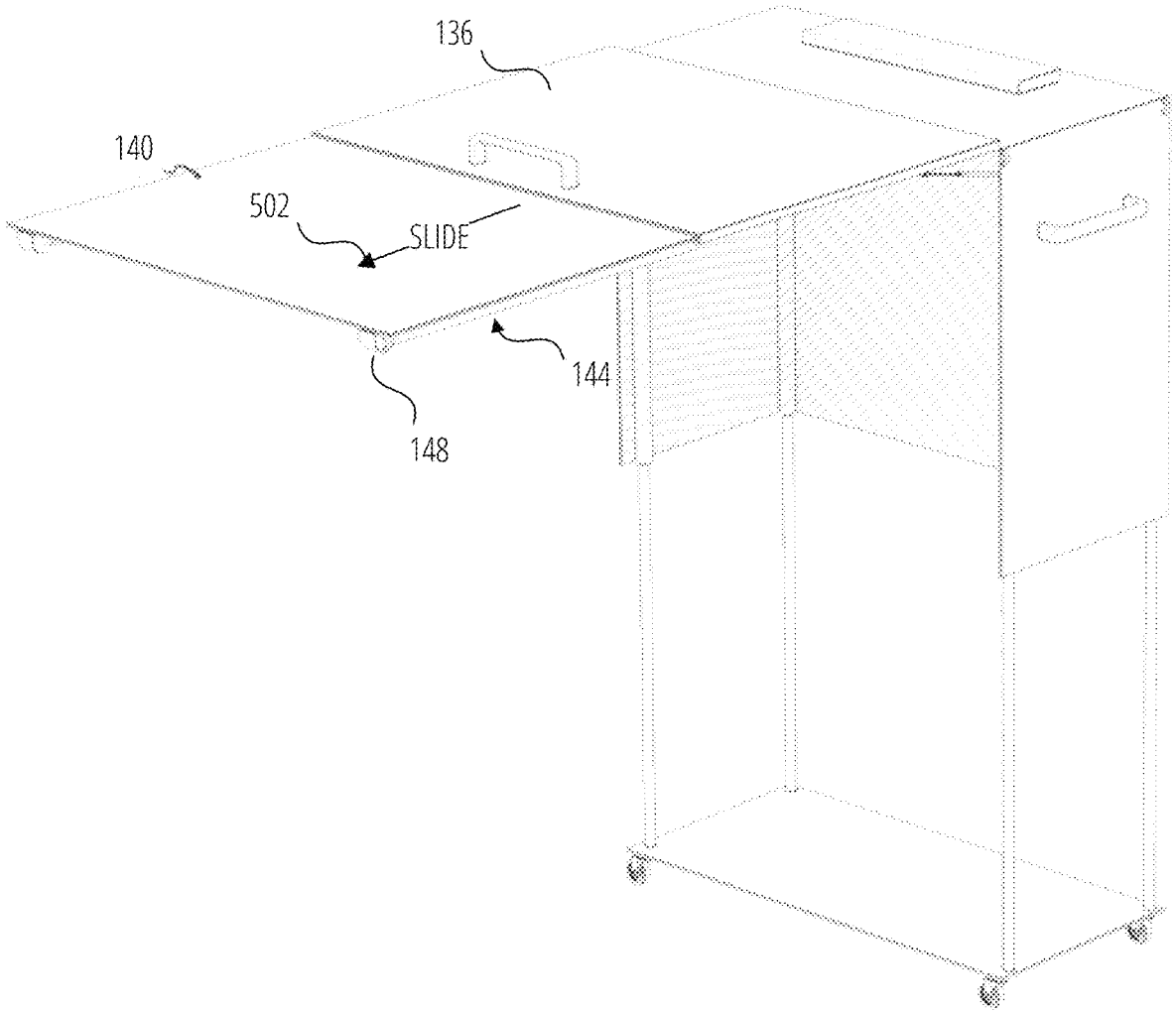
FIG. 5 illustrates the outdoor cooking appliance enclosure in a third interim configuration, in accordance with at least some embodiments of the present disclosure.

FIG. 5 illustrates the outdoor cooking appliance enclosure 100 in a third interim configuration, in accordance with at least some embodiments of the present disclosure. From the second interim configuration of FIG. 4, in a third step 502, the second panel 140 slides out of the first panel 136. In some embodiments, the second panel 140 is slid out manually, for example, after releasing the third locking arrangement, and by pulling the second panel 140, the extendable legs 144 or the rotation locking arrangement 148. In some embodiments, the second panel 140 is slid out manually, assisted by the third biasing arrangement. In some embodiments, the second panel 140 slides out automatically, by the third biasing arrangement. The extendable legs 144 are in a collapsed configuration and secured along the second panel 140 by the rotation locking arrangement 148.

Figure 6:
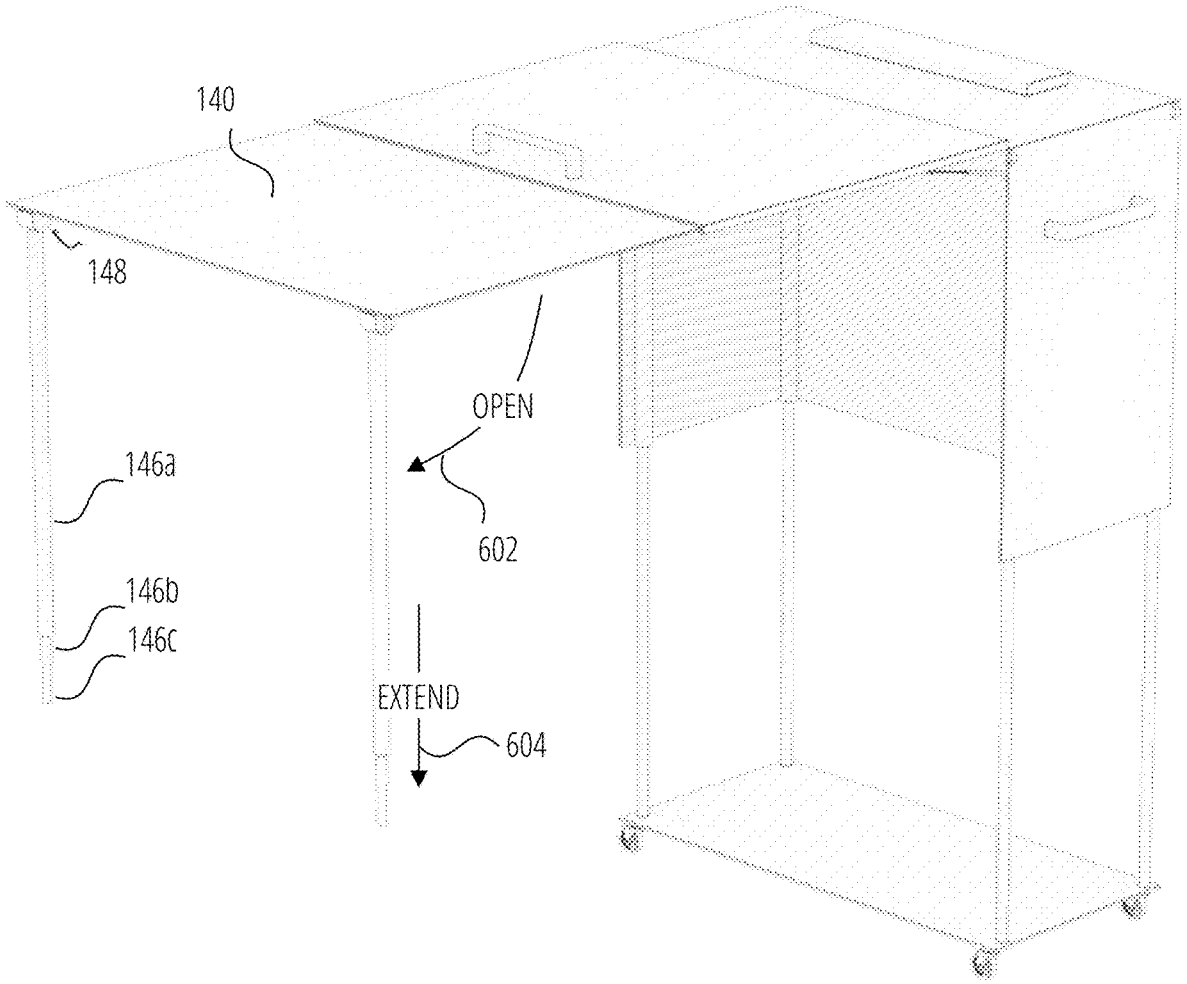
FIG. 6 illustrates the outdoor cooking appliance enclosure in a fourth interim configuration, in accordance with at least some embodiments of the present disclosure.

FIG. 6 illustrates the outdoor cooking appliance enclosure 100 in a fourth interim configuration, in accordance with at least some embodiments of the present disclosure. From the third interim configuration of FIG. 5, in a fourth step 602, the extendable legs 144 are opened, or allowed to hang vertically downward from the second panel 140, for example, by releasing the rotation locking arrangement 148, and allowing gravity to orient the extendable legs vertically downward. In some embodiments, the rotation locking arrangement 148 locks the extendable legs 144 in the vertically downward orientation to prevent further rotation of the extendable legs 144 with respect to the second panel 140. In a fifth step 604, the extendable legs 144 are extended to release the fourth locking arrangement to bring the legs 146*a*, 146*b*, 146*c* to a non-overlapping configuration, such that the legs 146*a*, 146*b*, 146*c* are extended, and achieve a length from the second panel 140 to the ground. The fourth locking arrangement is configured to lock the legs 146*a*, 146*b*, 146*c* to maintain rigidity of the achieved length, and support the second panel 140 in maintaining a horizontal orientation, parallel to the first panel. In this manner, the retracted configuration as depicted in FIG. 1 is achieved.

Figure 7:
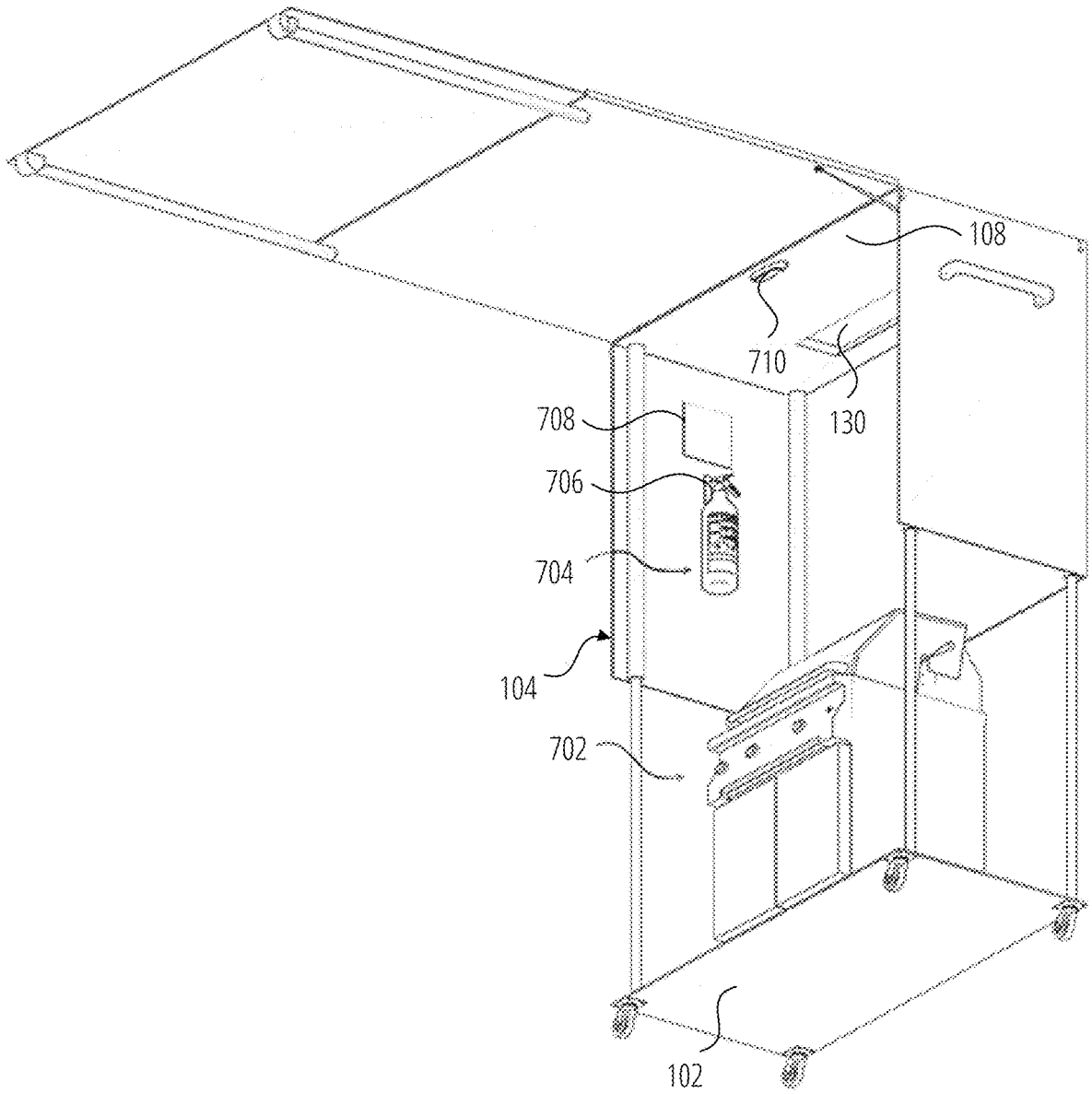
FIG. 7 illustrates an outdoor cooking appliance enclosure in a third interim configuration with an outdoor cooking appliance enclosure and accessories, in accordance with at least some embodiments of the present disclosure.

FIG. 7 illustrates an outdoor cooking appliance enclosure 100 in a third interim configuration with an outdoor cooking appliance 702 and accessories, in accordance with at least some embodiments of the present disclosure. For example, the accessories include, without limitation, a fire extinguisher 704 mounted on a hook 706, and a signage 708, each of which is mounted on the box enclosure 104. A lamp holder 710 is mounted on the roof 108 to provide light for better visibility.

In some embodiments, the outdoor cooking appliance enclosure 100 is made from metals, plastics, ceramics, glass or a combination thereof. In some embodiments, the outdoor cooking appliance enclosure 100 is made from one or more of sheet metal stainless steel, galvanized iron, aluminum, ceramics, or plastics.

While the foregoing is directed to embodiments of the present disclosure, other and further embodiments of the disclosure may be devised without departing from the basic scope thereof.

The invention claimed is:

1. An outdoor cooking appliance enclosure for storing and operating a cooking appliance, the outdoor cooking appliance enclosure comprising:

a base comprising a plurality of guide rods extending vertically upward from the base;

a box enclosure extending vertically upward from a bottom edge, the box enclosure mounted on the plurality of guide rods, and movable in a vertical direction along the plurality of guide rods, wherein the plurality of guide rods are located along peripheral edges of the box enclosure, and wherein the box enclosure further includes a plurality of guide rod receivers configured to receive the plurality of guide rods, the box enclosure comprising:

a roof mounted on top of and covering the box enclosure, a back wall, a first sidewall extending forward from a first vertical edge of the back wall and, a second sidewall extending forward from a second vertical edge of the back wall, the back wall positioned between and fixed to the first sidewall and the second sidewall, a front door shaped to form a closed volume with the box enclosure and the base, the front door extending from the roof to the bottom edge, the front door comprising at least two panels comprising a first panel and a second panel, the first panel mounted pivotably along a front edge of the roof, and the second panel extendable from the first panel in a direction parallel to the first panel, wherein the front door is positioned between the first sidewall and the second sidewall, and wherein the front door forms a closed shape with the box enclosure, and a plurality of extendable legs mounted pivotably on the second panel, the extendable legs configured to extend between a first length and a second length different from the first length, wherein in an extended configuration of the outdoor cooking appliance enclosure, the first and second side walls remain fixed to the back wall, and wherein the first and second side walls and the back wall remain fixed to the plurality of guide rod receivers;

a locking arrangement between the plurality of guide rod receivers and the plurality of guide rods, wherein the locking arrangement is one of a gas or hydraulic pressure mechanism, or manual locks that clip into place, with associated lock-release mechanisms, and wherein the locking arrangement is configured to:

lock the plurality of guide rods relative to the plurality of guide rod receivers at a first relative position between the guide rods and the guide rod receivers to secure the box enclosure positioned with the bottom edge of the box enclosure proximal to the base in a bottom-locked position, unlock the plurality of guide rods relative to the guide rod receivers to release the box enclosure free to move vertically along the guide rods in an unlocked configuration, and lock the plurality of guide rods relative to the plurality of guide rod receivers at a second relative position between the guide rods and the guide rod receivers to secure the box enclosure positioned with a top edge of the box enclosure proximal to the roof in a top-locked position.

2. The outdoor cooking appliance enclosure of claim 1, wherein, in a retracted configuration of the outdoor cooking appliance enclosure, the box enclosure is positioned with the bottom edge of the box enclosure in contact with the base in a bottom-locked position.

3. The outdoor cooking appliance enclosure of claim 1, wherein, in a closed position, the front door extends from the front edge of the roof to a front edge of the base.

4. The outdoor cooking appliance enclosure of claim 1, wherein the second panel is nested within the first panel and configured to slide with respect to the first panel.

5. The outdoor cooking appliance enclosure of claim 1, wherein the extendable legs are retracted and oriented along the second panel, and wherein, in an extended configuration of the outdoor cooking appliance enclosure:

the box enclosure is positioned with the bottom edge of the box enclosure distal from the base in a top-locked position, and the front door extends from the front edge of the roof, along the roof in a horizontal direction, the second panel extends out from and parallel to the first panel, and the plurality of extendable legs are fully extended vertically downward from the second panel.

6. The outdoor cooking appliance enclosure of claim 1, wherein the plurality of guide rod receivers and the guide rods comprise a biasing arrangement to bias the box enclosure vertically upward, wherein the biasing arrangement is configured to move the box enclosure automatically, in a vertically upward direction, from the position of the bottom-locked position to the position of the top-locked position, and wherein the biasing arrangement is one of a gas or hydraulic piston or a spring mechanism to bias the box enclosure vertically upward.

7. The outdoor cooking appliance enclosure of claim 1, wherein the first panel comprises at least two slots on sides of the first panel, the at least two slots configured to accommodate edges of the second panel and allow a sliding movement of the second panel along the at least two slots.

8. The outdoor cooking appliance enclosure of claim 1, further comprising a second locking arrangement of the front door, wherein the second locking arrangement is configured to:

secure the second panel in an overlap with the first panel in a retracted configuration, release the second panel free to extend from the first panel in an unlocked configuration, and secure the second panel extending from and parallel to the first panel in an extended configuration.

9. The outdoor cooking appliance enclosure of claim 1, wherein the extendable legs are telescopic legs, the first length being shorter or equal to a depth of the first panel in a retracted configuration, and the second length being equal to or larger than a height between the base and the roof in an extended configuration, the outdoor cooking appliance enclosure further comprising a second locking arrangement of the extendable legs, wherein the second locking arrangement is configured to:

secure the extendable legs along the second panel in the retracted configuration, release the extendable legs to hang vertically downward from the second panel, and extend vertically downward to the ground in an extended configuration in an unlocked configuration, and secure the extendable legs in the extended configuration.

10. The outdoor cooking appliance enclosure of claim 1, further comprising at least one of a window, a vent, a lamp holder, a hook, a signage, or a handle on at least one of the box enclosure, the first panel, or the second panel.

11. The outdoor cooking appliance enclosure of claim 1, further comprising a bias support mounted between the box enclosure and the first panel, the bias support configured to bias the first panel away from the box enclosure, and rest parallel to the roof in the horizontal direction.

12. The outdoor cooking appliance enclosure of claim 1, further comprising a plurality of casters extending downward from and supporting the base.

13. The outdoor cooking appliance enclosure of claim 12, wherein the base, supported by the plurality of casters, has a load capacity of 500 lbs.

14. The outdoor cooking appliance enclosure of claim 1, wherein in a retracted configuration of the outdoor cooking appliance enclosure, the box enclosure is positioned with the bottom edge of the box enclosure in contact with the base in a bottom-locked position, and in an extended configuration of the outdoor cooking appliance enclosure, the box enclosure is positioned with the bottom edge of the box enclosure not in contact with the base, wherein the extendable legs are telescopic legs having a storage length that is less than or equal to a height of the first panel in the retracted configuration of the outdoor cooking appliance enclosure, and have a telescopically extended length that is equal to or larger than a height between the base and the roof in the extended configuration of the outdoor cooking appliance enclosure, wherein the extended length is larger than the storage length.

* * * * *